United States Patent [19]

Foster et al.

[11] 4,401,330

[45] Aug. 30, 1983

[54] MEANS FOR, AND A METHOD OF, SECURING A CLOSURE

[75] Inventors: John R. Foster, Indianapolis; James E. Placke, New Palestine, both of Ind.

[73] Assignee: Von Duprin, Inc., Indianapolis, Ind.

[21] Appl. No.: 263,109

[22] Filed: May 13, 1981

[51] Int. Cl.[3] ..... E05C 15/00

[52] U.S. Cl. ..... 292/300; 292/DIG. 44; 292/DIG. 66

[58] Field of Search ..... 292/2, 300, 138, DIG. 44, 292/DIG. 66

[56] References Cited

U.S. PATENT DOCUMENTS

| | | | |
|---|---|---|---|
| 251,432 | 12/1881 | Goff | 292/300 |
| 310,223 | 1/1885 | Rappleyea | 292/300 |
| 778,001 | 12/1904 | Bell | 292/300 |
| 3,606,423 | 9/1971 | McCarthy | 292/300 X |

*Primary Examiner*—Richard E. Moore

*Attorney, Agent, or Firm*—B. J. Murphy

[57] ABSTRACT

In the preferred embodiment depicted, the invention comprises a limb, having a depending lug, fixed to a door. The lug makes a close clearance, near engagement with a socket-retainer fixed to a door-interfacing mullion. The upper end of the mullion is foreshortened, and addressed to a free space; it is slidably engaged with an internal socket. Accordingly, in the event of fire, the mullion may freely extend vertically, due to the heat. Such free extension causes the socket-retainer, and the depending lug, mutually to engage. By this arrangement, the door is secured closed, on the exposure to severe heat, even if the normal latching and/or locking device therefor comes loose or disengaged. The method comprehends fixing the mullion at one end, securing it against angular movement, exposing the other end to a free space, and mounting to the closure and mullion locking components which come into engagement only in response to thermal extension of the mullion.

11 Claims, 4 Drawing Figures

MEANS FOR, AND A METHOD OF, SECURING A CLOSURE

This invention pertains to locking methods and means, latching devices, and the like, and in particular, to such methods, means and devices for securing a closure, such as a door, bulkhead, and the like, in a closed condition in the event of fire.

In buildings and structures which have fire doors or bulkheads, or the like which, for reasons of safety and/or security, must be sealed at all times, such closures, of course, have a locking or latching device of some type. Typically, the door has a latching element which engages a strike plate, the latter being mounted on a mullion or similar, vertical, framing member. In the event of fire, however, the mullion tends, or attempts to do so, and becomes distorted, bent, twisted or otherwise deformed. As a result, the latching device disengages, and the fire door or whatever can come open. This occurs because the mullion is fixed at its lower end to the floor or floor-supported frame member, and is likewise fixed at the upper end to a frame member or beam or the like. As the mullion is heated, it endeavors to elongate, but being fixed at each end, it can only distort and deform, causing the disengagement of the locking or latching device.

What have been needed are a method and a means for securing a closure, i.e., a door, bulkhead, or the like, which, in response to thermal distortion of the interfacing mullion or such vertical member, will effect a supplementary or safety locking, to insure that the closure will remain closed. However, such means must always be disengaged and, in fact, not engageable at all, under normal ambient conditions.

It is an object of this invention to meet the aforesaid need with a method and a means for securing a closure in response to a thermal distortion of the mullion or like frame member to which, at least in part, the means are fixed.

In particular, it is an object of this invention to set forth means for securing a closure, such as a door or the like, in closed interface with an elongate element, such as a mullion, a frame member, or the like, in response to a thermal distortion of such element comprising: first locking means for mounting thereof to a closure; and second locking means for mounting thereof to an elongate element with which said closure defines an interface, upon said closure being closed; wherein one of said first and second locking means comprises a rigid component having a relief formed therein; and the other of said first and second locking means comprises a limb lockingly engageable with said relief upon (a) said closure being in closed interface with said element, and (b) said element manifesting thermal distortion.

It is also an object of this invention to set forth a method of securing a closure, such as a door or the like, in closed interface with an elongate element, such as a mullion, a frame member, or the like, in response to a thermal distortion of such element, comprising: fixing one end of the element to an immobile bearing surface; securing the element against angular movement thereof relative to such fixed one end; exposing the other end of the element to a free space; and mounting to the element and to the door separate locking components which lockingly engage only upon (a) the closure being in closed interface with the element, and (b) at least the element manifesting thermal distortion.

Further objects of this invention as well as the novel features thereof will become more apparent by reference to the following description taken in conjunction with the accompanying figures in which.

Figure 3:
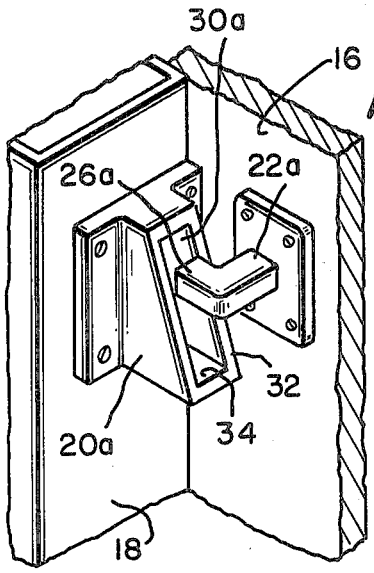
FIGS. 3 and 4 are isometric projections, approximately to the FIG. 1 scale, of alternative embodiments of the invention.

As shown in the figures, a double door arrangement 10 comprises a horizontal frame member 12 having a recessed shoulder 14, with which the doors 16 (only one is shown) mate on closure, and a vertical member or mullion 18 against which the doors 16 close. The mullion 18 is foreshortened; it has a length which will not reach from the base of the doorway to the underside at the frame member 12, for reasons to be explained. The mullion 18 has a socket-retainer 20 fixed thereto. The door 16 carries a limb 22 having a projecting shank 24 and a depending lug 26. Under normal ambient conditions, the lug 26 makes a close clearance, near engagement with the socket-retainer 20.

The horizontal frame member 12 has a four-sided socket 28 fixed thereto about which is received, and fixed against angular movement, the upper hollow end 18' of the mullion 18. While not shown, a corresponding socket 28 receives the lower end of the mullion; the mullion, however, fully engages the lower socket 28. Accordingly, in the presence of fire, the mullion 18 will manifest a controlled thermal distortion. Its upper end has a free space, having a depth "A", through which it may extend thermally. While the mullion 18 is "bottomed" at its lower end, on the lower socket 28, the upper end is free to extend slidably upon the socket 28, and this is why its length is foreshortened. As a consequence, the mullion 18 will not bend, twist or otherwise become distorted, except by elongation. While "growing" thermally, the mullion 18 carries the socket-retainer 20 slightly upward to where the lug 26 becomes confined by the walls of a recess 30 formed in the socket-retainer. Now, the door 16 cannot open, no matter what has become the condition of the normal latching mechanism (not shown).

Figure 2:
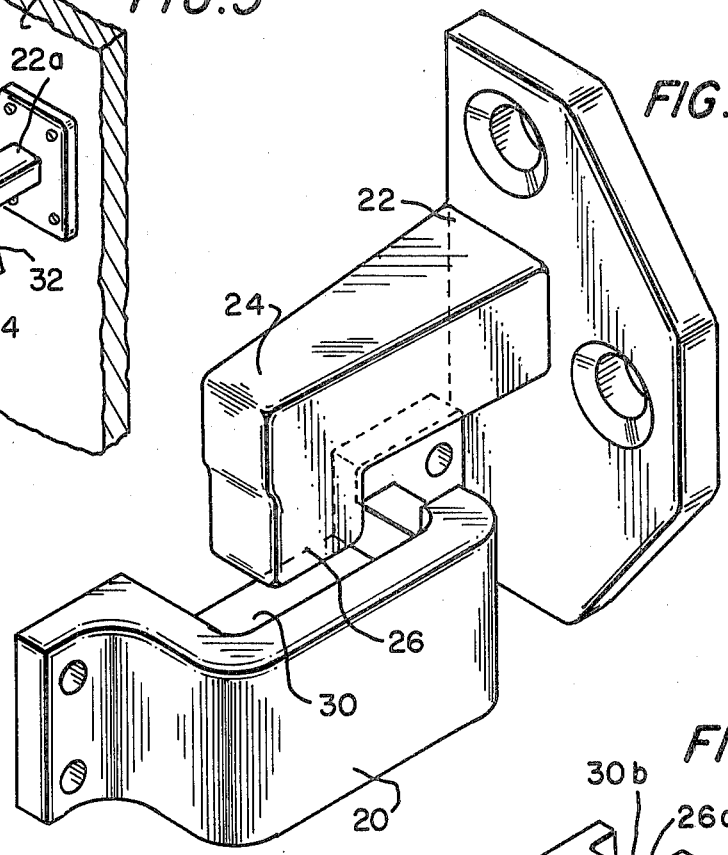
FIG. 2 is a greatly enlarged isometric projection of the closure securing means of FIG. 1.
Figure 4:
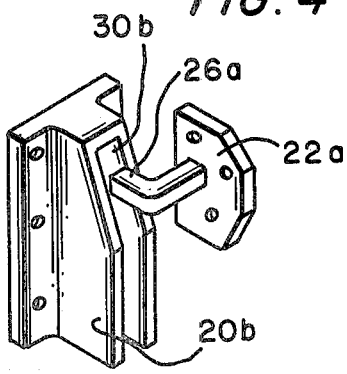
Figure 1:
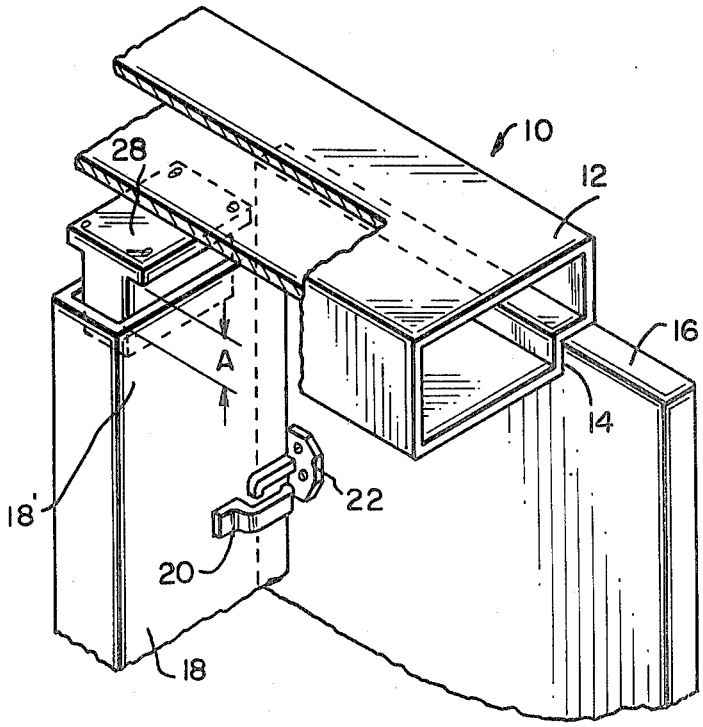
FIG. 1 is an isometric projection of a portion of a double door arrangement having a horizontal, door-engaging frame member and a door-interfacing mullion, the same showing the novel closure securing means.

FIGS. 3 and 4 depict alternative embodiments of the invention in which same or similar index numbers denote elements which are the same as, or similar to elements in FIGS. 1 and 2. The socket-retainer **20*a*, in FIG. 3, defines a diagonally-disposed outward face 32 of a walled recess 30*a*, the same having a bottom wall 34. Under thermal expansion of the mullion 18, the socket-retainer 20*a* rises to engage the lug 26*a* of the door-carried limb 22*a*. The FIG. 4 embodiment is similar to that of FIG. 3, except that the socket-retainer 20*b*** has no bottom wall.

While we have described our invention in connection with specific embodiments thereof, it is to be clearly understood that this is done only by way of example, and not as a limitation to the scope of our invention as set forth in the objects thereof and in the appended claims.

We claim:

1. A method of securing a closure, such as a door or the like, in closed interface with an elongate element, such as a mullion, a frame member, or the like, in response to a thermal distortion of such element, comprising:

fixing one end of the element to an immobile bearing surface;

securing the element against angular movement thereof relative to such fixed one end;

exposing the other end of the element to a free space; and mounting to the element and to the door separate locking components which lockingly engage only upon (a) the closure being in closed interface with the element, and (b) at least the element manifesting thermal distortion.

2. A method of securing a closure, according to claim 1, wherein:

said securing and exposing steps comprise enclosing said other end in an immobile shell.

3. A method of securing a closure, according to claim 1, wherein:

said mounting step comprises attaching a socket-retainer to the element, and attaching a projecting limb to the closure; and said attaching steps comprise attaching the socket-retainer and the limb so that (a) they close upon each other with a minute clearance therebetween, in the absence of thermal distortion of said element, and (b) as aforesaid, come into locking engagement in response to thermal distortion of said element.

4. A socket-retainer, for use with closure-securing means, comprising:

means defining a mounting plate; and a boss raised from said plate-defining means; wherein said boss has a relief formed therein;

said plate-defining means comprises a flat mounting surface;

said boss extends from said plate-defining means normal to said mounting surface, and has an outermost surface which lies diagonally relative to said mounting surface; and said relief is formed in said outermost surface.

5. In combination with (a) a closure, such as a door or the like, which is movable to define a closed interface with an elongate element, such as a mullion, a frame member, or the like, and (b) a closure-interfacing elongate element as aforesaid, means for securing the closure in closed interface with the elongate element in response to a thermal distortion of such element, comprising:

first locking means mounted to the closure; and second locking means mounted to the elongate element with which said closure defines an interface, upon said closure being closed; wherein one of said first and second locking means comprises a rigid component having a relief formed therein; and the other of said first and second locking means comprises a limb lockingly engageable with said relief upon (a) said closure being in closed interface with said element, and (b) said element manifesting thermal distortion.

6. The combination, according to claim 5, wherein:

said limb is of substantially right-angular configuration, having a shank with a longitudinal axis, and a lug extending from said shank substantially normal to said axis.

7. The combination, according to claim 5, wherein:

said components, comprises a socket-retainer;

said socket-retainer having a walled recess formed therein which defines said relief.

8. The combination, according to claim 7, wherein:

said socket-retainer has an aperture formed therein.

9. The combination, according to claim 8, wherein:

said recess comprises an opening; and said aperture is formed in said opening.

10. The combination, according to claim 8, wherein:

said recess formed in said socket-retainer is defined by a pair of substantially parallel walls;

said walls having diagonally-disposed terminal edges.

11. The combination, according to claim 5, wherein:

said component comprises means defining a slot.

* * * * *